US008042250B2

(12) United States Patent
Dubois

(10) Patent No.: US 8,042,250 B2
(45) Date of Patent: Oct. 25, 2011

(54) METHOD FOR SUBSEQUENT REINFORCEMENT OF INJECTION-MOLDED TRANSPORT MEANS

(75) Inventor: Jean-Marc Dubois, Bremgarten (CH)

(73) Assignee: Georg Utz Holding AG, Bremgarten (CH)

( * ) Notice: Subject to any disclaimer, the term of this patent is extended or adjusted under 35 U.S.C. 154(b) by 856 days.

(21) Appl. No.: 12/148,601

(22) Filed: Apr. 21, 2008

(65) Prior Publication Data

US 2008/0256777 A1 Oct. 23, 2008

(30) Foreign Application Priority Data

Apr. 23, 2007 (DE) ..... 10 2007 019 415

(51) Int. Cl.
*B23P 11/02* (2006.01)
*B23P 21/00* (2006.01)
*B65D 19/38* (2006.01)

(52) U.S. Cl. ..... 29/450; 29/784; 108/57.28

(58) Field of Classification Search ..... 29/450, 29/451, 453, 784; 108/57.28, 57.31, 56.3, 108/57.25, 187, 51.11, 155, 147.17
See application file for complete search history.

(56) References Cited

U.S. PATENT DOCUMENTS 3,699,901 A * 10/1972 Cook, III ..... 108/57.25
7,748,330 B2 * 7/2010 Dubois et al. ..... 108/56.3

FOREIGN PATENT DOCUMENTS

DE 10 2004 049 201 4/2006
EP 0 071 467 2/1983
WO WO 97/21598 6/1997

* cited by examiner

*Primary Examiner* — John C Hong
(74) *Attorney, Agent, or Firm* — Collard & Roe, P.C.

(57) ABSTRACT

A method subsequently reinforces injection-molded transporters such as plastic pallets, which have support feet disposed on their underside, at least at the corners, and a groove for inserting a reinforcement profile between two support feet that stand diagonally opposite one another, and the two ends of the groove are formed by pockets shaped to correspond to the profile cross-section, disposed in the region of the support foot assigned to the groove end, in each instance. After completion of the pallet, the distance between the two pockets is increased via elastic deformation of the pallet. Afterwards, the reinforcement profile is laid into the groove, and one end of the profile is laid into one of the pockets. Thereafter, the deformation is canceled out and the pallet returns to the relaxed original state, and in this connection the other end of the reinforcement profile also dips into the corresponding pocket.

6 Claims, 3 Drawing Sheets

METHOD FOR SUBSEQUENT REINFORCEMENT OF INJECTION-MOLDED TRANSPORT MEANS

CROSS-REFERENCE TO RELATED APPLICATIONS

Applicant claims priority under 35 U.S.C. §119 of German Application No. 10 2007 019 415.5 filed Apr. 23, 2007.

BACKGROUND OF THE INVENTION

1. Field of the Invention

The present invention relates to a method for subsequent reinforcement of injection-molded transport means such as plastic pallets or bottoms of plastic containers.

2. The Prior Art

Such transport means are mass-produced articles that are produced in large numbers. Therefore, even slight simplifications in production are of great economic benefit. Aside from inexpensive production, however, sufficient stability of the transport means has to be guaranteed.

In the case of non-reinforced transport means, bending at higher temperatures during shelf storage is particularly high. Specifically for this purpose of use, however, possibilities have to be present so that this bending can be kept as low as possible.

In the case of normal use on a forklift truck or floor storage, however, the non-reinforced version of the transport means is sufficient.

SUMMARY OF THE INVENTION

It is therefore an object of the invention to configure transport means so that they can be subsequently reinforced to prevent bending, without parts of the finished, molded transport means having to be disassembled and subsequently reassembled.

These and other objects are achieved, according to the invention, by disposing support feet on the underside of the plastic pallet or container bottom, at least at the corners, and providing a groove for inserting a reinforcement profile between two support feet that stand diagonally opposite one another. The two ends of the groove are formed by pockets shaped to correspond to the profile cross-section, disposed in the region of the support foot assigned to the groove end, in each instance. After completion of the pallet or the container bottom, the distance between the two pockets is increased via elastic deformation of the pallet or container bottom. Afterwards the reinforcement profile is laid into the groove, and one end of the profile is laid into one of the pockets. Thereafter, the deformation is canceled out and the pallet or container bottom returns to the relaxed original state, and in this connection the other end of the reinforcement profile also dips into the corresponding pocket.

The material properties of the transport means make it possible to deform the pallet or container bottom, within a certain framework, to such an extent that the profile can be laid in and that after force is no longer exerted on the pallet or the container bottom, the pallet or container bottom can return to its starting position, because of its elasticity.

In this connection, in a preferred embodiment, the pallet or container bottom is stretched in the longitudinal groove direction.

When this stretching is done, a few centimeters of lengthening are sufficient, so that the free end of the profile, in other words the one that lies opposite the end that has already been inserted into the pocket, comes to lie in front of the entrance to the pocket. After the stress is relieved, the pocket then moves over this free end of the profile. Thus, the profile is securely held on the underside (possibly also on the top), and prevented from falling out.

Other deformations for increasing the distance between the two pockets are also possible. For example bending of the groove about an axis that lies perpendicular to the longitudinal groove direction is possible.

The pockets can be injection-molded on separately, next to the support feet. However, it is also possible to integrate the pockets into the side walls of the support feet.

Metal (steel, aluminum, etc.), for example, may be used as a material for the reinforcement strips.

Metal and plastic have different heat expansion coefficients. Accordingly, attention must be paid to ensure that the reinforcement strip is accommodated in the pockets with play, so that the greater heat expansion of the metal profile does not destroy the plastic surroundings of the pallet or the container bottom.

For this reason, it is also not technically feasible for the metal profile to be injection-molded into the pallet or the container bottom during the injection-molding process itself.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Figure 1:
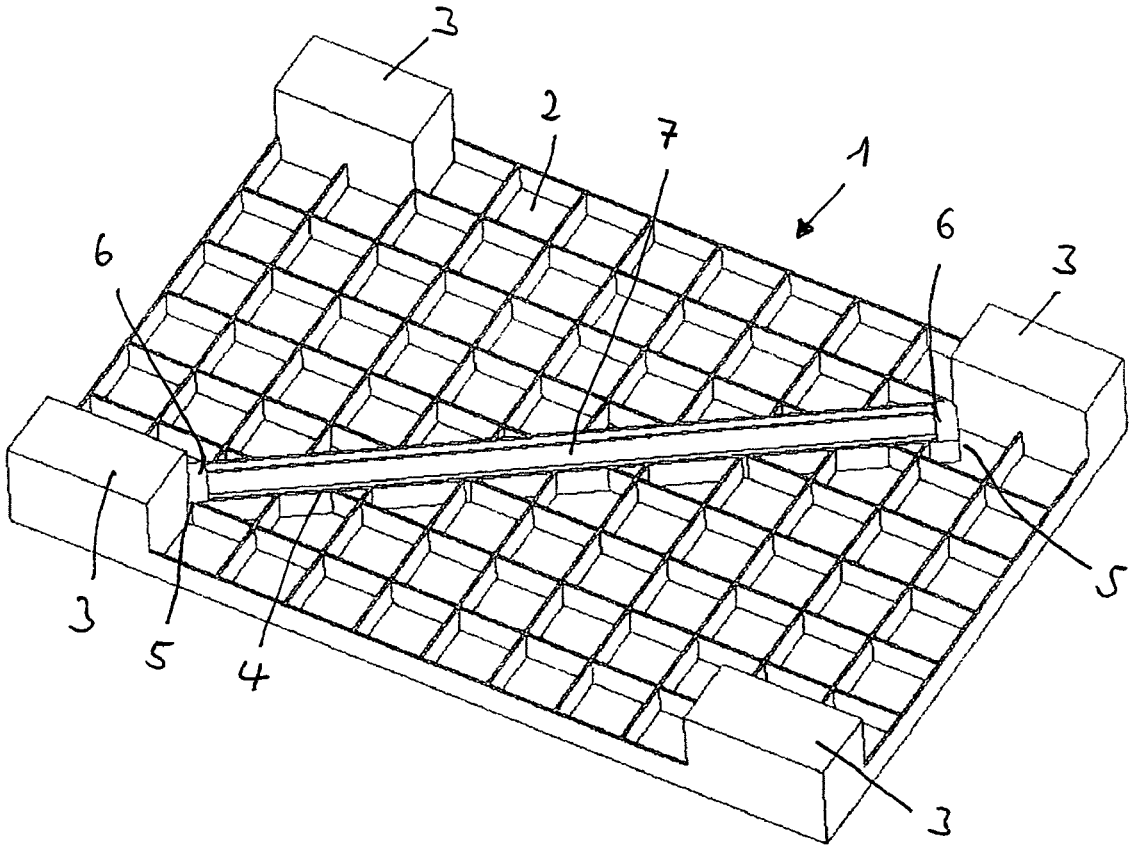
FIG. 1 is a perspective view of the underside of an injection-molded plastic pallet in accordance with an embodiment of the invention.

Referring now in detail to the drawings, FIGS. 1-4 show a plastic pallet indicated in general with the reference number 1. Pallet 1 is made up of a loading surface 2, which is configured in honeycomb shape on its underside, and thus demonstrates greater stability. Support feet 3 are molded on at the four corners of loading surface 2. A groove 4 is molded into the honeycomb-shaped underside of loading surface 2, between two support feet 3 that lie diagonally opposite one another, which groove is delimited, at its ends 5, which are disposed in the immediate vicinity of the support foot 3, in each instance, by pockets 6. In this connection, the openings of the pockets point towards one another in the longitudinal groove direction.

A reinforcement strip 7 is laid into groove 4 and pockets 6. This figure shows the final state of the reinforced pallet.

Figure 2:
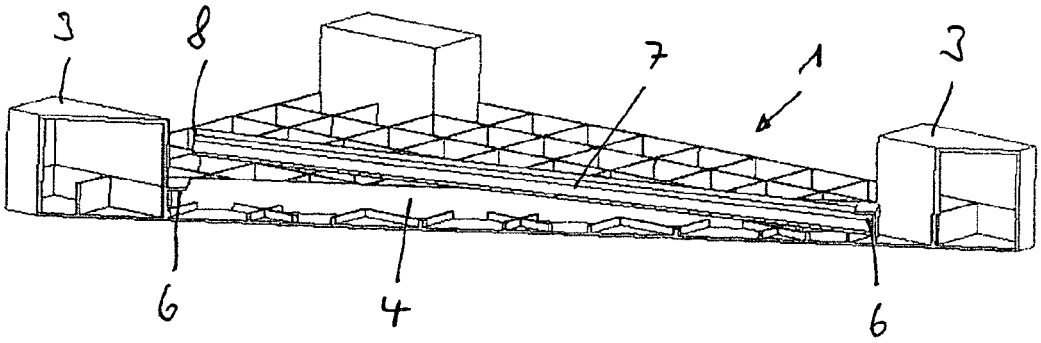
FIG. 2 shows the pallet according to FIG. 1 in the stretched state (in section)
Figure 3:
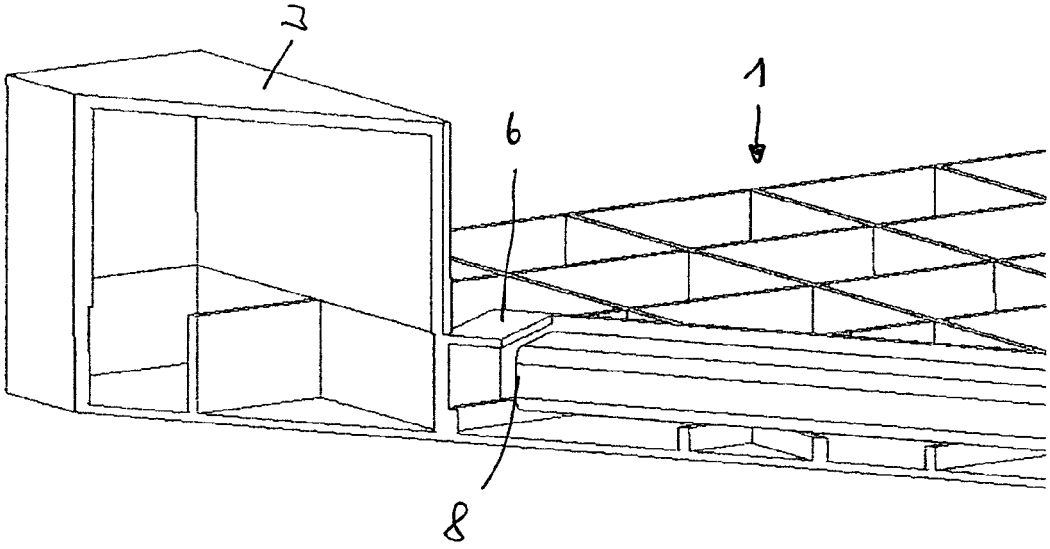
FIG. 3 is a detail enlargement from FIG. 2.
Figure 4:
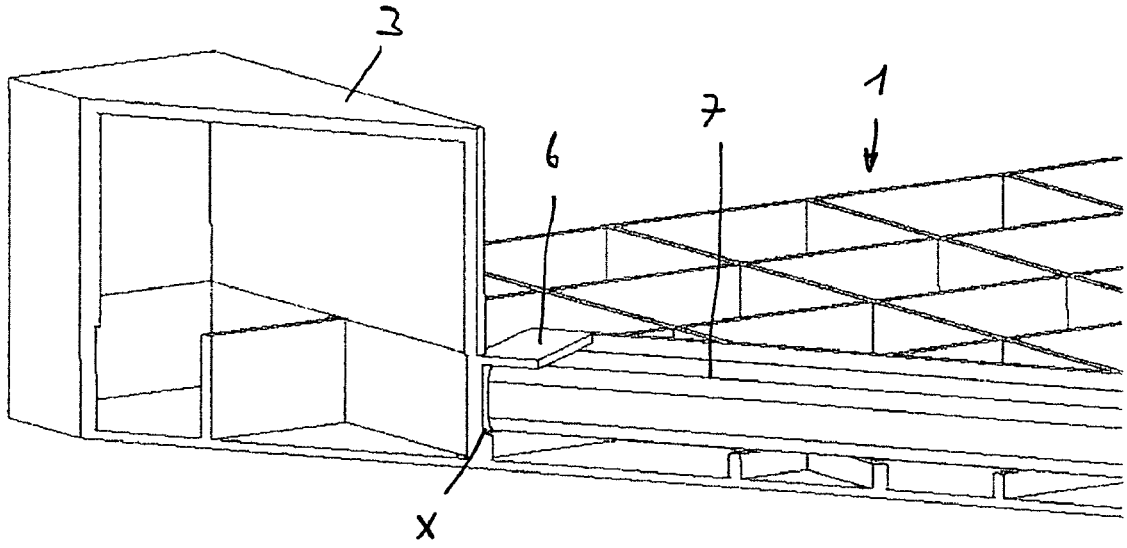
FIG. 4 is a detail enlargement according to FIG. 3, but in the stress-relieved state.

The method for inserting reinforcement strip 7 is evident from FIGS. 2 to 4.

Pallet 1 shown in FIG. 1 is shown stretched in the longitudinal groove direction in FIG. 2, in section. Reinforcement strip 7 is already inserted into the right pocket 6. The free end 8 of reinforcement strip 7 is situated above opposite pocket 6.

As is more clearly evident from FIG. 3, this free end 8 is in front of the opening of pocket 6 in this process.

In FIG. 4, the final state (FIG. 1) is then shown again. Here, the force required for deformation of the pallet is no longer in effect. As a result of its elasticity, pallet 1 returns to its original state, whereby pocket 6 moves over free end 8 of reinforcement strip 7.

As is also evident from this figure, free end 8 of reinforcement strip 7 does not reach all the way to the bottom of pocket 6. This play x (FIG. 4) is necessary due to the different heat expansion coefficients of reinforcement strip material and pallet plastic.

Accordingly, although only at least one embodiment of the present invention has been shown and described, it is apparent that many changes and modifications may be made thereunto without departing from the spirit and scope of the invention.

What is claimed is:

1. A method for subsequent reinforcement of an injection-molded transporter comprising the steps of:

(a) providing a transporter having a honeycomb shaped underside portion comprising a plurality of support feet disposed on at least corners of the underside portion of the transporter and a groove for inserting a reinforcement profile between first and second support feet of the plurality of support feet that stand diagonally opposite one another, the groove having first and second ends respectively formed with first and second pockets shaped to correspond to a cross-section of the reinforcement profile and respectively disposed near the first and second support feet, the first and second pockets being spaced from each other by a distance;

(b) applying force to the transporter to increase the distance between the first and second pockets by elastically deforming the transporter;

(c) subsequently placing the reinforcement profile into the groove;

(d) placing a first profile end of the reinforcement profile into the first pocket; and (e) subsequently removing the force to cause the transporter to return to a relaxed state wherein a second profile end of the reinforcement profile dips into the second pocket.

2. The method according to claim 1, wherein the transporter comprises a plastic pallet or a plastic container bottom and the pallet or the container bottom is stretched in a longitudinal groove direction.

3. The method according to claim 1, wherein the first and second ends of the groove are bent out of a plane of the transporter.

4. The method according to claim 1, wherein the first and second pockets are respectively integrated into the first and second support feet.

5. The method according to claim 1, wherein the reinforcement profile comprises metal.

6. The method according to claim 2, wherein the reinforcement profile is accommodated in the first and second pockets with play in the longitudinal groove direction.

* * * * *